US006263592B1

(12) United States Patent
Chen

(10) Patent No.: US 6,263,592 B1
(45) **Date of Patent: *Jul. 24, 2001**

(54) FOOTWEAR PAD

(76) Inventor: Yi-Hsi Chen, No. 112, Min Tsu Road, Fu Li Li, Miao Li City, Miao Li Hsien (TW)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/340,160

(22) Filed: Jun. 28, 1999

(51) Int. Cl.[7] ..... A43B 13/40

(52) U.S. Cl. ..... 36/44; 36/141

(58) Field of Search ..... 36/44, 43, 141

(56) References Cited

U.S. PATENT DOCUMENTS

| | | | |
|---|---|---|---|
| 3,641,688 | * | 2/1972 | Von Den Benken . |
| 4,510,700 | * | 4/1985 | Brown . |
| 4,800,657 | * | 1/1989 | Brown . |
| 4,843,738 | * | 7/1989 | Masuda . |
| 5,146,698 | * | 9/1992 | Tilles . |
| 5,233,768 | * | 8/1993 | Humphreys . |
| 5,976,100 | * | 11/1999 | Greenawalt . |

* cited by examiner

*Primary Examiner*—Ted Kavanaugh
(74) *Attorney, Agent, or Firm*—Browdy and Neimark

(57) ABSTRACT

A footwear pad comprises a resilient layer of a plastic foam material, a protective layer of a wear-resistant cloth and adhered to the upper surface of the resilient layer, and a magnetic layer made of a magnetic rubber sheet and provided with magnetism which is distributed uniformly and unidirectionally so as to stimulate effectively the blood circulation in the feet of a user of the footwear pad.

2 Claims, 2 Drawing Sheets

FOOTWEAR PAD

FIELD OF THE INVENTION

The present invention relates generally to a footwear, and more particularly to a healthful pad for use in the footwear.

BACKGROUND OF THE INVENTION

A shoe pad of the prior art is provided with a plurality of inlaid block magnets or spherical magnets, which are intended to promote the blood circulation in the feet of a wearer of the shoes. Such a healthful effect of the prior art shoe pad is achieved by magnetism of the inlaid magnets. However, the healthful effect of the prior art shoe pad is, in fact, not as good as expected, with the reason being that the inlaid magnets are not uniformly distributed, and that the magnetism of each inlaid magnet works alone. In other words, the healthful effect of the prior art shoe pad is compromised by the fact that all inlaid magnets of the prior art shoe pad can not be made to act together.

SUMMARY OF THE INVENTION

It is therefore the primary objective of the present invention to provide an improved footwear pad with a powerful and evenly-distributed magnetism for bringing about a healthful effect on user of the footwear pad.

It is another objective of the present invention to provide a footwear pad with not only magnetism but also an excellent elasticity and an excellent compressibility.

In keeping with the principle of the present invention, the foregoing objectives of the present invention are attained by a footwear pad comprising a resilient layer which is intended to provide the footwear pad with an excellent resiliency and an excellent shock-absorbing effect. The resilient layer is made of a plastic foam material and provided with a reinforcing layer, which is made of a tear-resistant cloth and adhered to the upper side of the resilient layer. The resilient layer is further provided with a magnetic layer which is made of a magnetic rubber sheet and adhered to the underside of the resilient layer. The magnetic layer is magnetized in accordance with the required magnetic strength at the time when the footwear pad is made. The footwear pad is thus provided by the magnetic layer with magnetism that is distributed uniformly and unidirectionally so as to promote effectively the blood circulation in the feet of a user of the footwear pad.

DETAILED DESCRIPTION OF THE INVENTION

Figure 1:
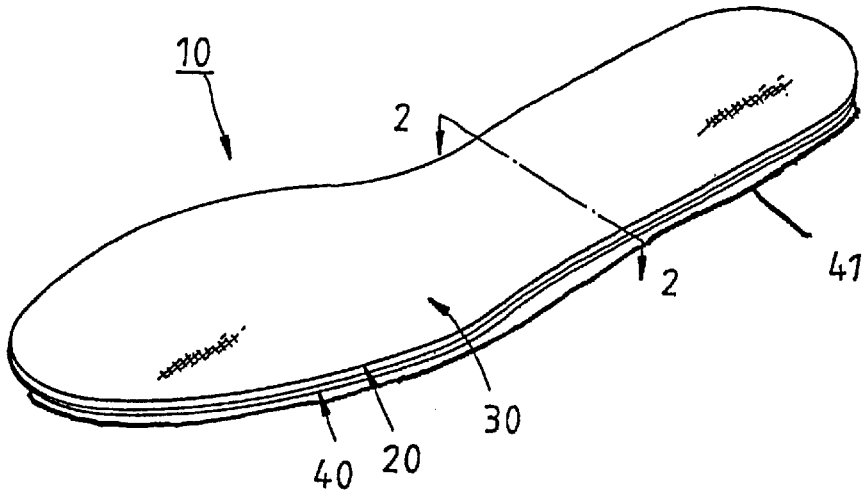
FIG. 1 shows a perspective view of a first preferred embodiment of the present invention.
Figure 2:
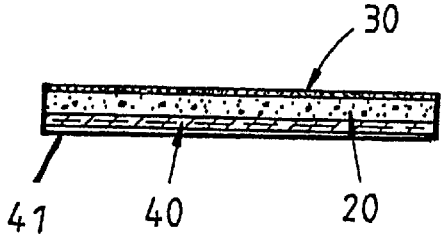
FIG. 2 shows a cross-sectional view taken along the direction indicated by a line 2—2 as shown in FIG. 1.

As shown in FIGS. 1 and 2, a footwear pad 10 of the first preferred embodiment of the present invention is corresponding in shape and size to an insole of the footwear.

The footwear pad 10 comprises a resilient layer 20, a reinforcing layer 30 adhered to the upper side of the resilient layer 20, and a magnetic layer 40 adhered to the underside of the resilient layer 20. The reinforcing layer 30 comes in direct contact with the sole of a person's foot.

The resilient layer 20 is about 3 mm in thickness and is made of a plastic foam material, such as a PU foam material.

The reinforcing layer 30 is made of a tear-resistant cloth capable of absorbing foot perspiration. The reinforcing layer 30 is attached securely to the upper side of the resilient layer 20 by an adhesive.

The magnetic layer 40 is about 1.5 mm in thickness and is made of a magnetic rubber sheet. The magnetic layer 40 has a minimum boundary magnetic flux density of 150 gausses, a maximum boundary magnetic flux density of 400 gausses, and a magnetic field penetration ranging between 0.1 mm and 120 mm. The magnetic layer 40 is attached securely to the underside of the resilient layer 20 by an adhesive. The magnetic layer 40 may be provided with a protective layer 41 which is made of a tear-resistant cloth and adhered to the underside of the magnetic layer 40.

Figure 3:
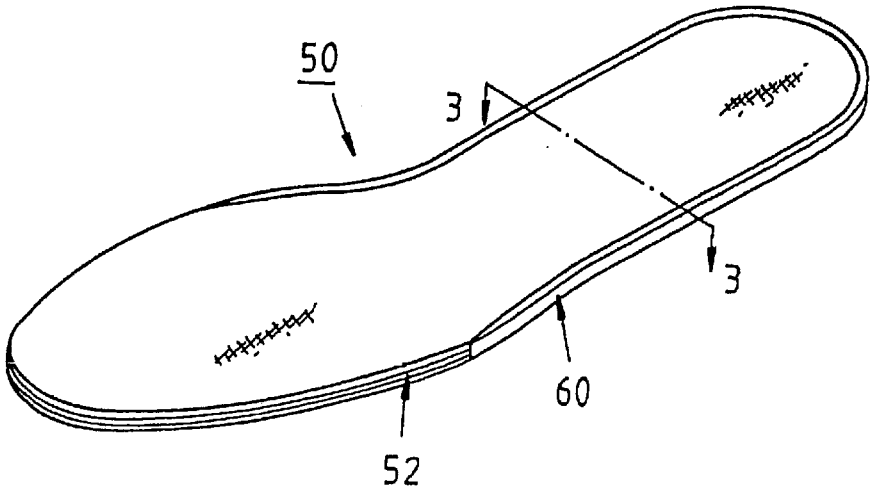
FIG. 3 shows a perspective view of a second preferred embodiment of the present invention.
Figure 4:
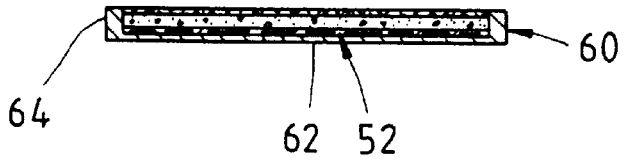
FIG. 4 shows a cross-sectional view taken in the direction indicated by a line 3—3 as shown in FIG. 3.

As shown in FIGS. 3 and 4, a footwear pad 50 of the second preferred embodiment of the present invention is basically similar to the footwear pad 10 of the first preferred embodiment of the present invention, with the exception being that the footwear pad 50 further comprises a protective jacket 60 which is made of a plastic foam material, such as EVA.

The protective jacket 60 comprises a main body 62 which is about 1 mm in thickness, and a side wall 64 which is about 4 mm in height and extends vertically from the outer edge of the main body 62 in such a manner that the side wall 64 is corresponding in location to edges of shank and heel of the footwear. In other words, the main body 62 and the side wall 64 form a jacket with an open top for receiving and protecting the shank portion and the heel portion of the footwear pad 50. The magnetic layer 52 is thus provided with protection against damage or wear caused by friction.

Figure 5:
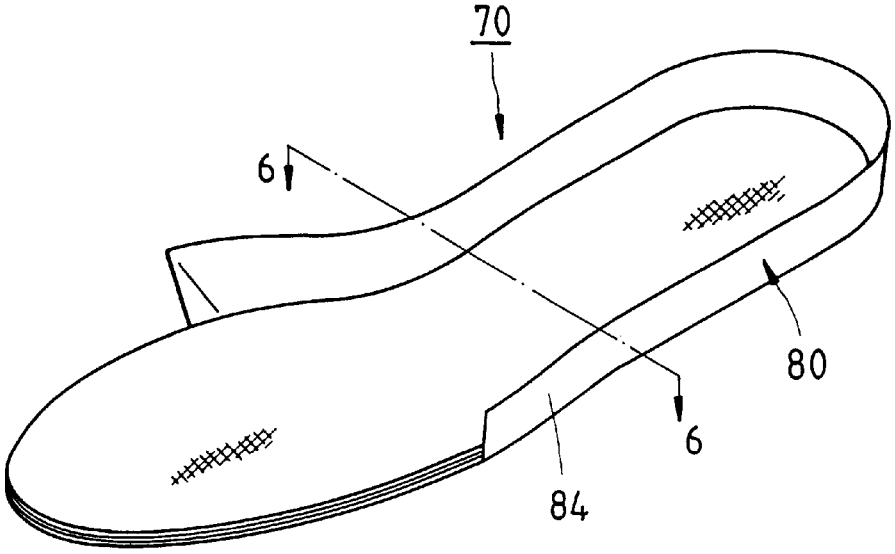
FIG. 5 shows a perspective view of a third preferred embodiment of the present invention.
Figure 6:
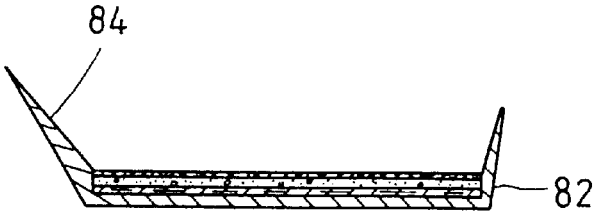
FIG. 6 shows a cross-sectional view taken along the direction indicated by a line 6—6 as shown in FIG. 5.

Now referring to FIGS. 5 and 6, a footwear pad 70 of the third preferred embodiment of the present invention is basically similar in construction to the footwear pad 50 of the second preferred embodiment of the present invention, except that the former 70 comprises a protective jacket 80 having a side wall 82 which is provided at a top side thereof with a protective piece 84 extending therefrom upwardly such that the protective piece 84 is so slanted to come in contact with the lining of the footwear, thereby enabling the protective piece 84 to be adhered to the lining of the footwear so as to locate securely the footwear pad 70 inside the footwear.

The present invention is capable of an effective stimulation of the blood circulation in foot, thanks to the magnetic layer of the present invention. In addition, the resilient layer of the present invention provides a wearing comfort as well as a durability to prolong the service lifespan of the footwear pad.

What is claimed is:

1. A footwear pad comprising:

a resilient layer of a thickness and made of a plastic foam material;

a reinforcing layer made of cloth and adhered to the upper side of said resilient layer;

a magnetic layer made of a magnetic rubber sheet and adhered to the underside of said resilient layer, said magnetic layer being configured to provide said footwear pad with a magnetic field that is distributed uniformly and unidirectionally across said footwear pad; and a protective layer made of cloth and adhered to the underside of said magnetic layer.

2. The footwear of claim 1 wherein said magnetic layer has a substantially uniform thickness.

* * * * *